US007506789B2

(12) United States Patent
Shor

(10) Patent No.: US 7,506,789 B2
(45) Date of Patent: Mar. 24, 2009

(54) CONTINUOUS FEED CAP SYSTEM

(75) Inventor: Ilya Shor, Brooklyn, NY (US)

(73) Assignee: Arrow Fastener Company, Inc., Saddle Brook, NJ (US)

( * ) Notice: Subject to any disclaimer, the term of this patent is extended or adjusted under 35 U.S.C. 154(b) by 0 days.

(21) Appl. No.: 11/730,603

(22) Filed: Apr. 3, 2007

(65) Prior Publication Data

US 2008/0048001 A1 Feb. 28, 2008

Related U.S. Application Data

(60) Provisional application No. 60/840,832, filed on Aug. 28, 2006.

(51) Int. Cl.
*B25C 7/00* (2006.01)

(52) U.S. Cl. ..... 227/147; 227/15; 227/16; 227/18; 227/31

(58) Field of Classification Search ..... 227/15, 227/16, 18, 31, 119, 120, 133, 146, 147
See application file for complete search history.

(56) References Cited

U.S. PATENT DOCUMENTS

| | | | | |
|---|---|---|---|---|
| 3,319,864 A | | 5/1967 | Adams | 227/76 |
| 3,385,498 A | | 5/1968 | Downie | 227/18 |
| 4,033,499 A | * | 7/1977 | Butler | 227/120 |
| 4,570,840 A | | 2/1986 | Bull | 227/8 |
| 4,610,385 A | | 9/1986 | Duchin | 227/67 |
| 4,723,357 A | | 2/1988 | Suyama et al. | 29/721 |
| 4,785,987 A | | 11/1988 | Strausburg | 227/67 |
| 4,795,072 A | | 1/1989 | Sodeno | 227/18 |
| 4,838,469 A | | 6/1989 | Strausburg | 227/67 |
| 5,292,048 A | * | 3/1994 | Vanderwiel | 227/21 |
| 5,297,713 A | | 3/1994 | Perra et al. | 227/123 |
| 5,323,919 A | | 6/1994 | Ito et al. | 221/173 |
| 5,326,012 A | | 7/1994 | Ito et al. | 227/119 |
| 5,785,230 A | | 7/1998 | Davignon et al. | 227/71 |
| 5,788,138 A | | 8/1998 | Deschenes et al. | 227/67 |
| 5,934,504 A | | 8/1999 | Elliott | 227/232 |
| 5,934,539 A | | 8/1999 | Lee | 227/109 |
| 5,947,362 A | | 9/1999 | Omli | 227/120 |

(Continued)

*Primary Examiner*—Thanh K Truong
(74) *Attorney, Agent, or Firm*—Fitzpatrick, Cella, Harper & Scinto

(57) ABSTRACT

A continuous cap feed mechanism for use with fastener driving device includes a housing for receiving a coiled strip of interconnected caps removably mounted the fastener driving device. The housing includes a passageway for guiding the strip of caps from the coil to a position beneath a fastener to be driven by the fastener driving device and an advancing mechanism for moving the leading cap on said strip from the passage to the position beneath the fastener to be driven after the fastener driving device drives a prior fastener into a cap and as it is moved away from the previously driven fastener. The advancing mechanism includes a driver movably mounted in the housing for movement between an extended and retracted position adjacent the location on the fastener driving device at which the fastener driving device drives fasteners. The driver is moved from its extended to its retracted position as it engages a work piece to which a cap is to be fastened is biased towards its extended position and includes a pusher mechanism for engaging a cap in the strip in the housing and urging the strip in the passageway towards the fastener driving device as the driver returns to its extended position when the housing is moved away from the work piece.

20 Claims, 13 Drawing Sheets

U.S. PATENT DOCUMENTS

| | | | | |
|---|---|---|---|---|
| 6,039,232 | A | 3/2000 | Snover | 227/150 |
| 6,145,725 | A | 11/2000 | Omli | 227/18 |
| 6,478,209 | B1 | 11/2002 | Bruins et al. | 227/16 |
| 6,543,666 | B1 | 4/2003 | Huang | 227/18 |
| 6,609,647 | B1 | 8/2003 | Lai | 227/120 |
| 6,779,700 | B2 | 8/2004 | Bruins et al. | 227/136 |
| 6,808,101 | B2 | 10/2004 | Laubach et al. | 227/109 |
| 6,966,389 | B1 | 11/2005 | Riggs | 173/1 |
| 6,968,945 | B2 | 11/2005 | Bruins et al. | 206/338 |
| 7,025,241 | B2 | 4/2006 | Castellanos | 227/18 |
| 2001/0052534 | A1 | 12/2001 | Liu et al. | 227/120 |
| 2003/0015565 | A1* | 1/2003 | Lee | 227/18 |
| 2003/0218044 | A1 | 11/2003 | Laubach et al. | 227/109 |
| 2006/0091179 | A1 | 5/2006 | Moeller et al. | 227/120 |
| 2006/0186167 | A1* | 8/2006 | Omli | 227/31 |

* cited by examiner

FIG. 13
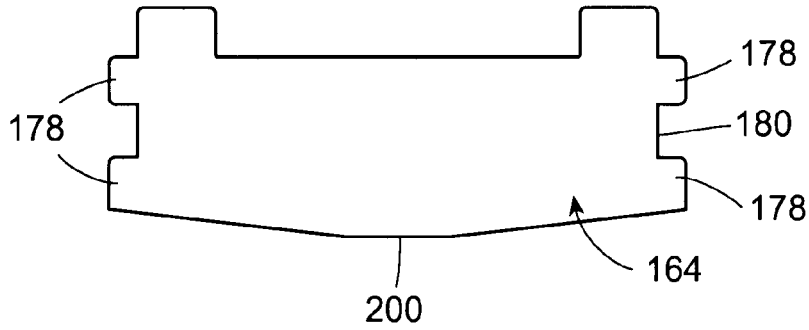
FIG. 14
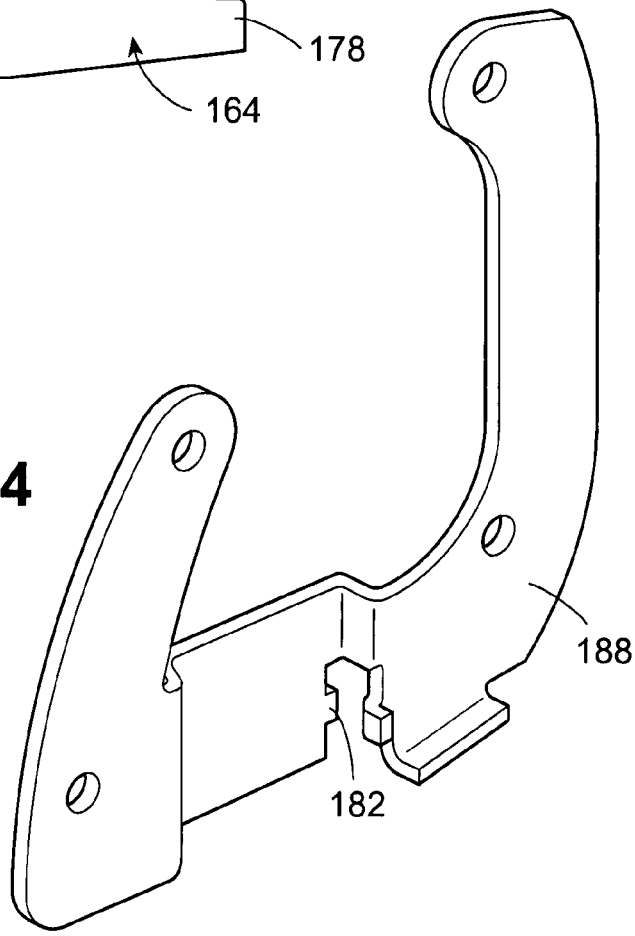
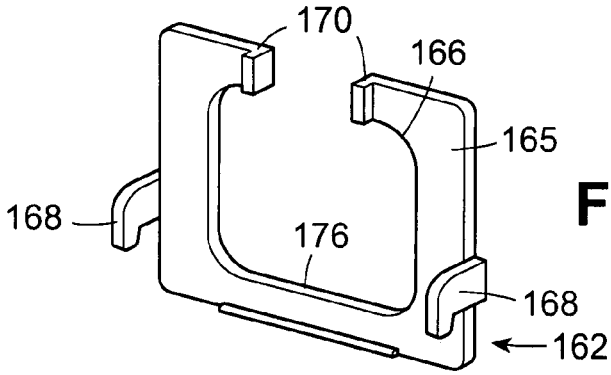
FIG. 15

FIG. 18
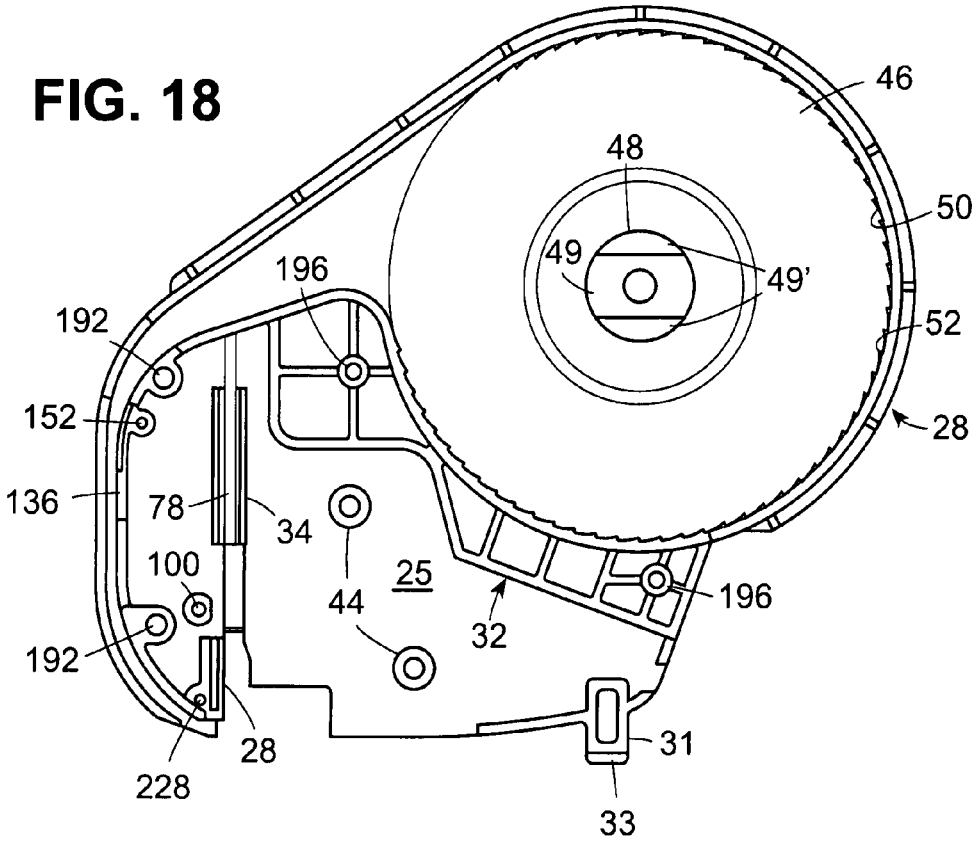
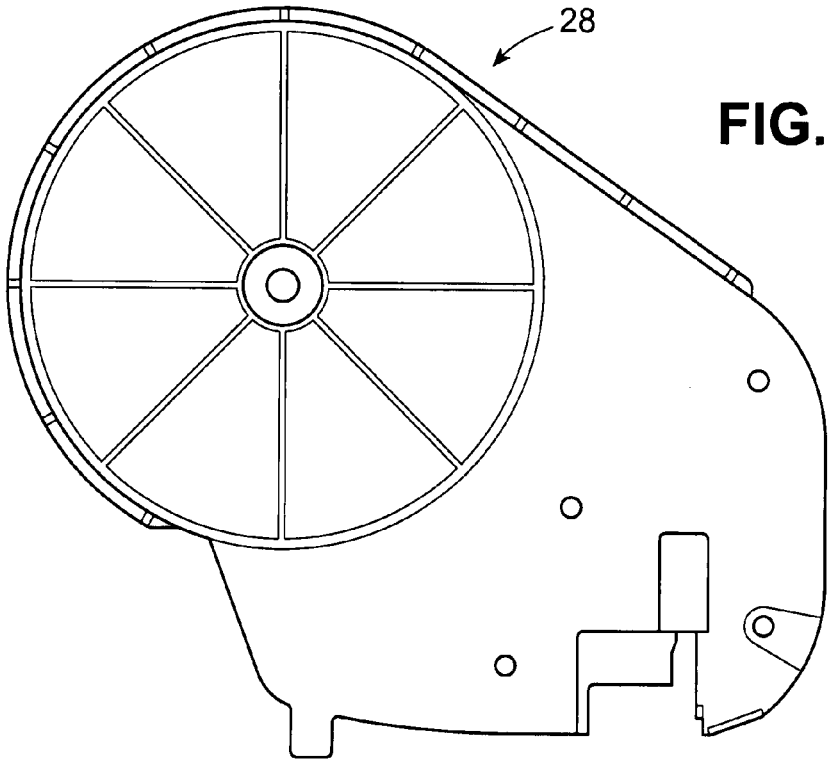
FIG. 19

CONTINUOUS FEED CAP SYSTEM

This application claims the benefit of Provisional Application No. 60/840,832 filed Aug. 28, 2006.

FIELD OF THE INVENTION

The present invention relates to fastener driving devices and more particularly to a continuous feed cap device for automatically feeding plastic caps to a position relative to a fastener driving device for allowing a fastener to be driven through the cap.

BACKGROUND OF THE INVENTION

It is well known in the art to utilize conventional powered or hand operated fastener driving devices to drive a nail or staple into a substrate. However, when fastening frangible materials, such as felt, plastic house wrap, sheeting, roofing, tar paper or the like, it often is necessary to use a so-called fastener cap with the nail or staple. Such caps minimize damage to the sheet material from the fastener and reduce leakage of moisture at the location of the fastener.

Originally, such fastener caps were applied manually by holding the fastener down against the substrate before applying the nail or staple and then manually driving the nail or staple through the fastener and sheet material into the substrate or work surface.

Because of the desirability of the use of such fastener caps, and the labor intensive, and hence expensive, process of manually applying the caps to the work substrate or work piece, a number of different forms of cap feeding devices have been developed over the years for use with automatic air or electric powered fastener drivers and also others for use with manual fastener drivers. However, typically such cap feeding devices are bulky, heavy, hard to handle, and require substantial modification of the underlying fastener tool for operation. Examples of complex automatic cap feeders for use with powered fastening devices are shown in U.S. Pat. Nos. 6,145,725 and 5,934,504.

Cap feeding devices designed for use with manual fastener drivers and particularly the well-known Arrow T50 and HT50 brand staple gun tackers are shown in U.S. Pat. Nos. 3,385,498 and 6,966,389 respectively. These devices each require the replacement or modification of some portion of the original staple gun with a modified component. For example, in U.S. Pat. No. 3,385,498 a modified nose piece for the staple gun is required to be used, while in U.S. Pat. No. 6,966,389 the movable striker or driver 14 must be replaced with a striker or driver that has at least one perforated side wall to accept a pivotal connection, or that side wall must be modified to provide a pivot hole before the feed device can be attached.

Accordingly, there is a present need for a continuous cap feeder assembly that can be easily attached to an existing hand operated fastener driving device, e.g. a staple gun tacker, without the need for any modification of the fastener driving device by the owner. Such a feed mechanism can be sold and marketed separately from a conventional staple gun tacker for retro fitting and/or removable mounting from the tacker.

While the present invention described herein is being directed particularly to a well-known HT50 brand staple gun tacker, as would be understood by those skilled in the art it can be readily adapted to other types of fastener driving devices, such as staple gun tackers or nailers, whether hand operated or powered by compressed air or electricity. Accordingly, as used herein, the terms fastener driving device and fastener respectively include staple guns, staple gun tackers, nailers and staples and nails or the like.

OBJECTS OF THE INVENTION

It is an object of the present invention to provide a continuous cap feed mechanism which can be easily mounted on and removed from an existing fastener driving device, and particularly to a hammer tacker type fastening device used to drive nails or staples.

Another object of the present invention is to provide a light weight compact continuous cap feed mechanism for mounting on a conventional fastener driving device.

Yet another object of the invention is to provide a continuous cap feed mechanism which is light weight and reliable in operation, while being readily removable from a conventional fastener driving device.

A still further object of the present invention is to provide a continuous cap feeding mechanism which is simple and reliable in operation and inexpensive to manufacture.

SUMMARY OF THE INVENTION

In accordance with an aspect of the present invention, a continuous cap feeding mechanism is provided which is adapted to the removably mounted on a conventional hammer tacker fastener driving device (also sometimes referred to herein as a "fastening device") or the like in a convenient manner by professionals or do-it-yourself home care enthusiasts. In the illustrative embodiment of the invention the cap feeding mechanism is disclosed as being adapted to be mounted on a conventional HT 50 brand Hammer Tacker which is a device well-known to those familiar with the fastening arts. The tacker is manually operated in a manner similar to the use of a hammer in that the drive head when impacted against a work piece by a swinging motion from the handle, fires a staple into the work piece.

In accordance with one aspect of the invention, the continuous cap feed mechanism includes a housing in which a continuous coil of interconnected preferably plastic cap members is received with one end of the coiled strip extending through a passage way in the housing arranged to direct the lead most cap in the strip to a position below the drive mechanism of the fastener driving device so that the lead most cap is positioned to be secured to the work piece when the fastener device drive head is struck against the work piece.

In accordance with another aspect of the present invention mechanism there is provided within the housing means for advancing the cap strip, one cap length at a time, immediately after the preceding cap has been secured into the work piece by a staple or nail. This self contained unit does not affect the structure of the fastener driving device itself and operates at the same time as the fastener driving device when the fastening device is struck against the work piece.

In yet another aspect of the present invention the continuous cap feeding mechanism includes a drive arrangement which includes a driver or driver plate located in the housing to be immediately adjacent to the drive head of the fastener driving device and slidably mounted in the housing to move between an extended position and a retracted position in the housing. In the extended position the bottom or foot of the driver is position to engage the work piece prior to the actuating device of the fastener driving device. Upon engagement with the work piece the driver moves into the housing towards its retracting position. A spring biased pusher element is secured to the driver for movement therewith. The pusher is itself biased into engagement with a section of the cap strip in the passage way of the housing and is pushed away from the path of travel of the cap strips as the driver is retracted during the striking motion. At the extreme retracted position of the driver, the pusher is biased into engagement between two caps on the strip. The driver itself is spring biased to its extended position so that when the fastening device is removed from the work piece, the driver is urged to its extended position with the result that the pusher pushes the strip in the passageway towards and along a path of travel leading to the area at the fastener driver device in which staples will be driven. The length of the stroke of the path of travel of the driver and hence of the pusher is arranged to be approximately the length of one cap.

In accordance with another aspect of the present invention the driver of the continuous cap feeding mechanism includes a knife or cutter secured thereto and located below the path of travel of the caps to the driving area of the fastener driving device so that as the driver reaches its fully retracted position the cutter or knife severs the connection between the lead cap and the immediately adjacent following cap of the strip.

In accordance with a still further aspect of the invention a stop or latching device is provided in the housing to prevent wayward movement of the strip of caps in the passageway during retraction of the driver.

The above, and other objects, features and advantages of the present invention will become apparent to those skilled in the art from the following detailed description of an illustrative embodiment of the invention when read in connection with the accompanying drawings which are merely illustrative, and wherein:

BRIEF DESCRIPTION OF THE DRAWINGS

FIG. 13 is a plain view of an upper cutter knife used in the feed mechanism;

FIG. 14 is a perspective view of one of two mirror image guide plates used on the feed mechanism;

FIG. 15 is a perspective view of the knife mounted which is shown mounted on the driver in FIG. 7;

FIG. 18 is an internal plain view of the other side of the housing used in the feed mechanism;

FIG. 19 is a plain view of the opposite side of the housing part shown in FIG. 18;

DETAILED DESCRIPTION OF THE INVENTION

Figure 1A:
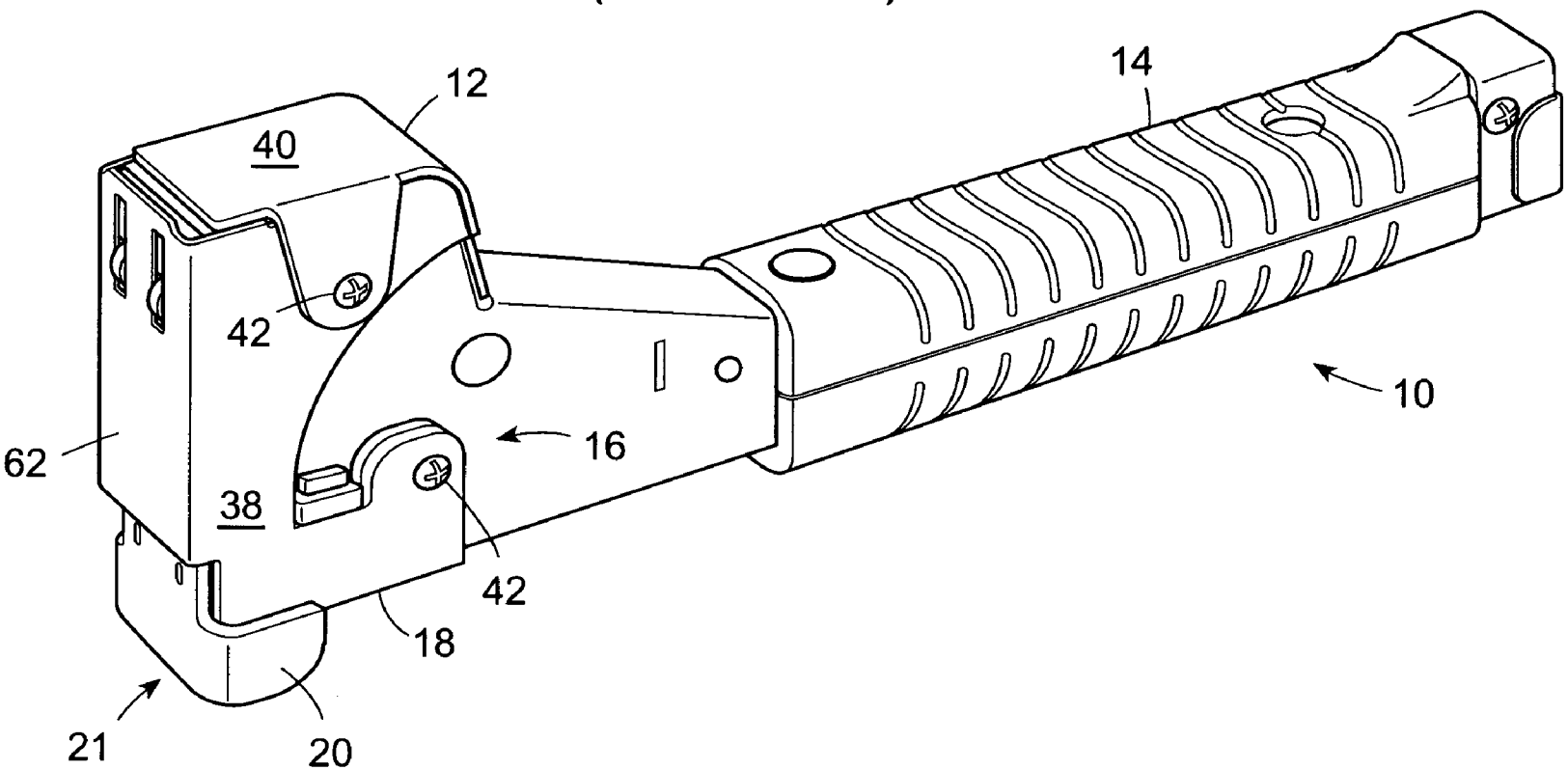
FIG. 1A (PRIOR ART)
FIG. 1A is a perspective view of a prior art hammer tacker used in accordance with the present invention.
Figure 1B:
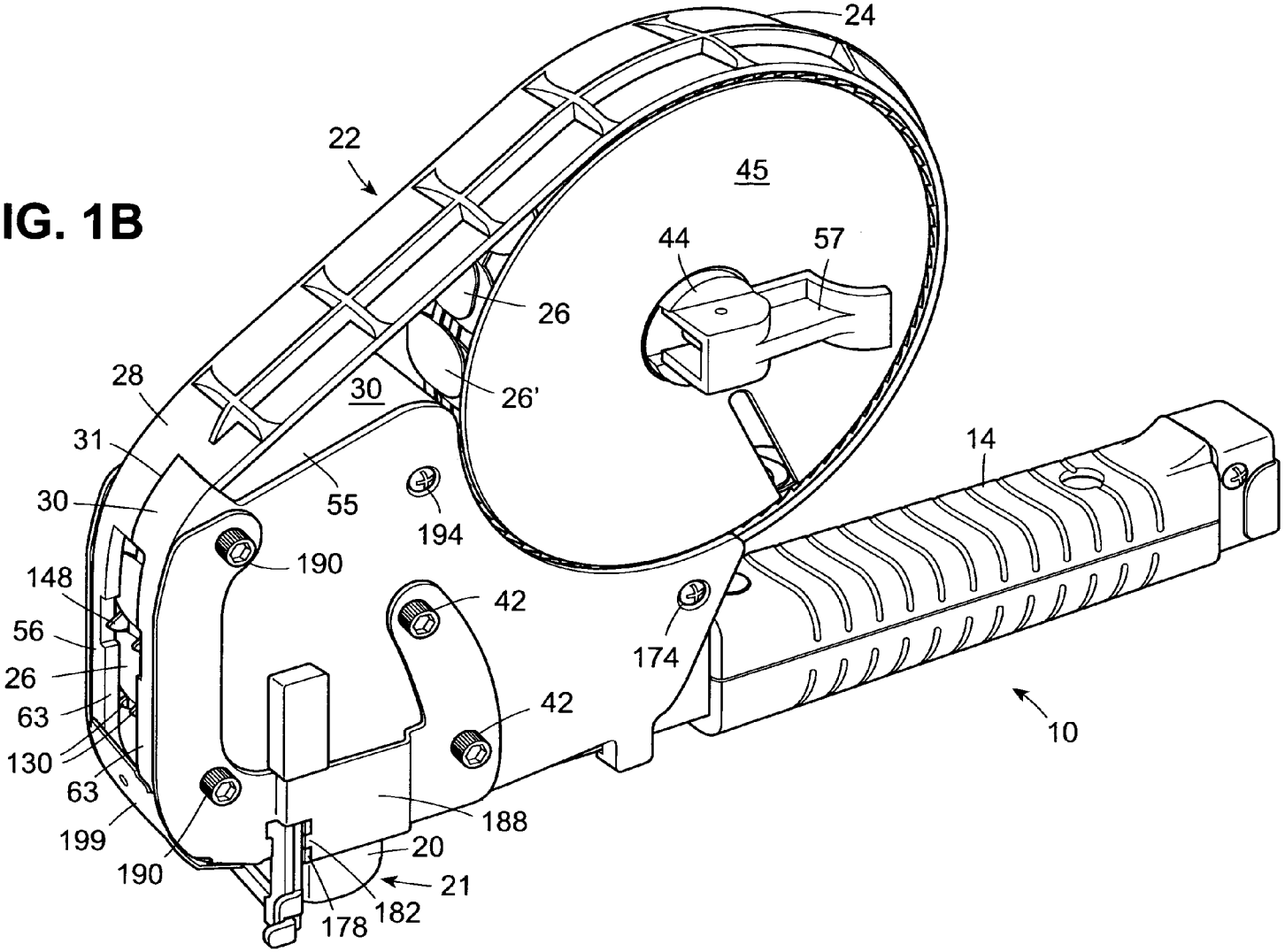
FIG. 1B is a perspective view of the continuous cap feed mechanism attached to the staple gun shown in FIG. 1.
Figure 2:
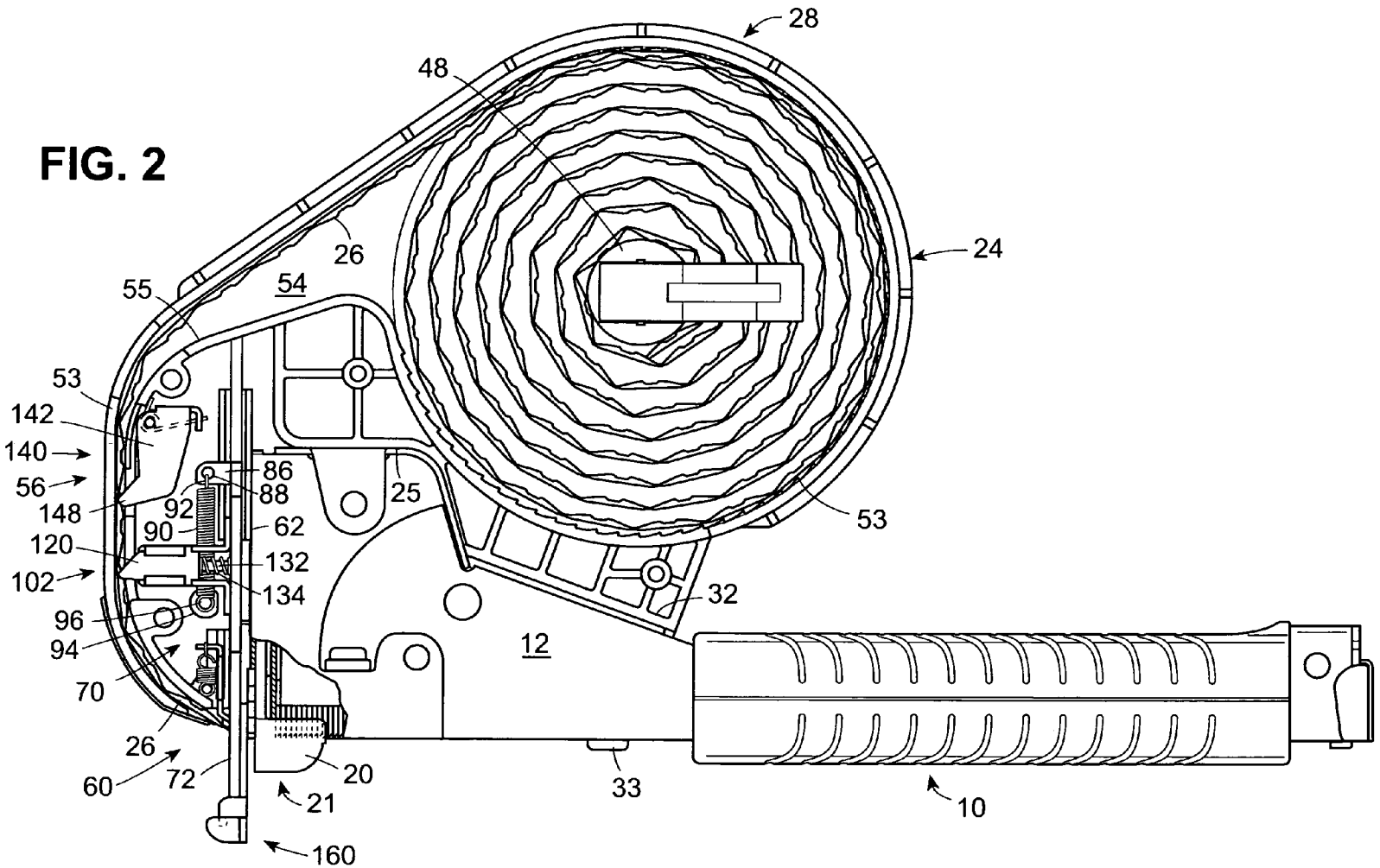
FIG. 2 is a side view of the attachment and hammer tacker shown in FIG. 1 with parts removed.

Referring now to the drawings in detail, and initially to FIGS. 1 and 2, a commercially available fastener driving device 10 is illustrated which is sold under the trade mark HT50 by the Arrow Fastener Company. This fastening device is a staple gun hammer tacker which includes a drive head 12 and a handle 14. Drive head 12 contains an operating mechanism 16 of known construction and is not described here in detail. However, basically, that drive mechanism includes a driver plate or knife which is activated to fire a staple into a work piece as the bottom surface 18 of the device is struck against the work piece by the user holding the handle 14. The drive mechanism includes a striker 20 which extends below the surface 18 and is adapted to retract into head 12 as it strikes a work piece under the force of the blow. The retraction of striker 20 into head 12 releases the internal operating mechanism to drive a knife or plate in head 12 which in turn drives a staple or nail from a strip of staples or nails stored in a magazine in handle 14. Such mechanisms are shown for example, in U.S. Pat. Nos. 2,896,210 and 2,757,378, the disclosures of which are incorporated herein by reference.

As noted above, the particular fastener driving device 10 illustrated in FIG. 1A is suitable for driving a staple in a workpiece, however, it could also be used with suitable modifications known to those skilled in the art to drive individual nails.

In operation, when striker 20 engages with a substrate or workpiece, the staple is driven from the head immediately behind striker 20 in the staple-firing or driving area 21.

FIG. 1B illustrates a continuous cap feed mechanism 22 secured to the head 12 of the fastener device 10, as described hereinafter.

Feed mechanism 22 includes a housing 24 which is adapted to contain a coil 26 of individual caps 26' which, upon operation of the device is moved to present the leadmost cap left on the coil under the fastener driving or striking area 21 of the fastener device 10. In that position when the fastener driving device is operated to strike the striker 20 against a substrates or work surface W (see FIGS. 3-5), a fastener will be driven into the cap and thus held firmly against the substrate or workpiece.

Figure 20:
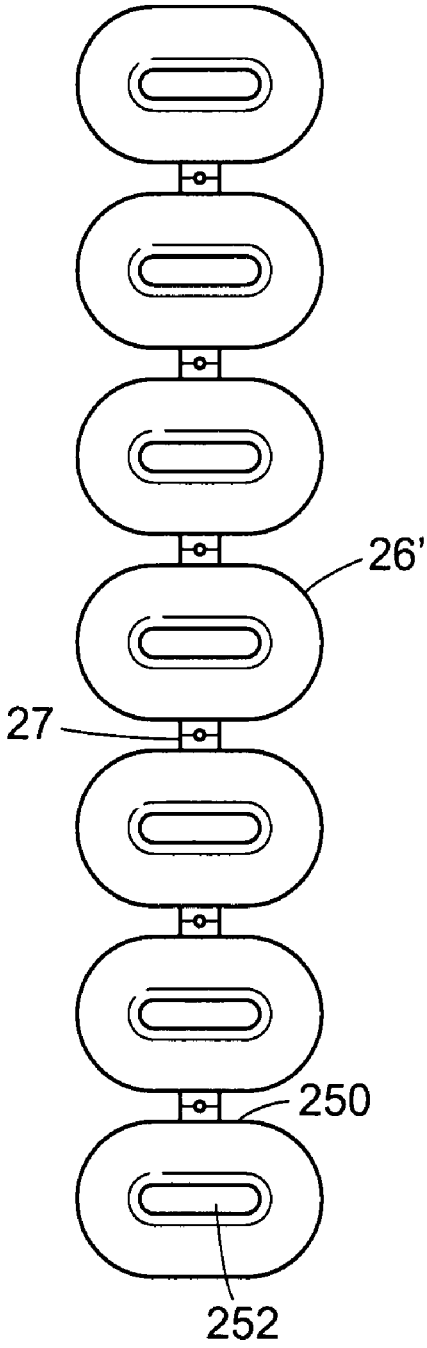
FIG. 20 is a plain view of a strip of caps used with the feed mechanism of the invention.

The caps used in the coil 26 according to the present invention are shown in FIG. 20. These individual caps are preferably formed of plastic and are connected to one another by a single small strip of plastic 27. The caps are shown somewhat schematically in FIG. 1B, and more schematically in the other views (of FIGS. 2-5) of the drawings.

Figure 16:
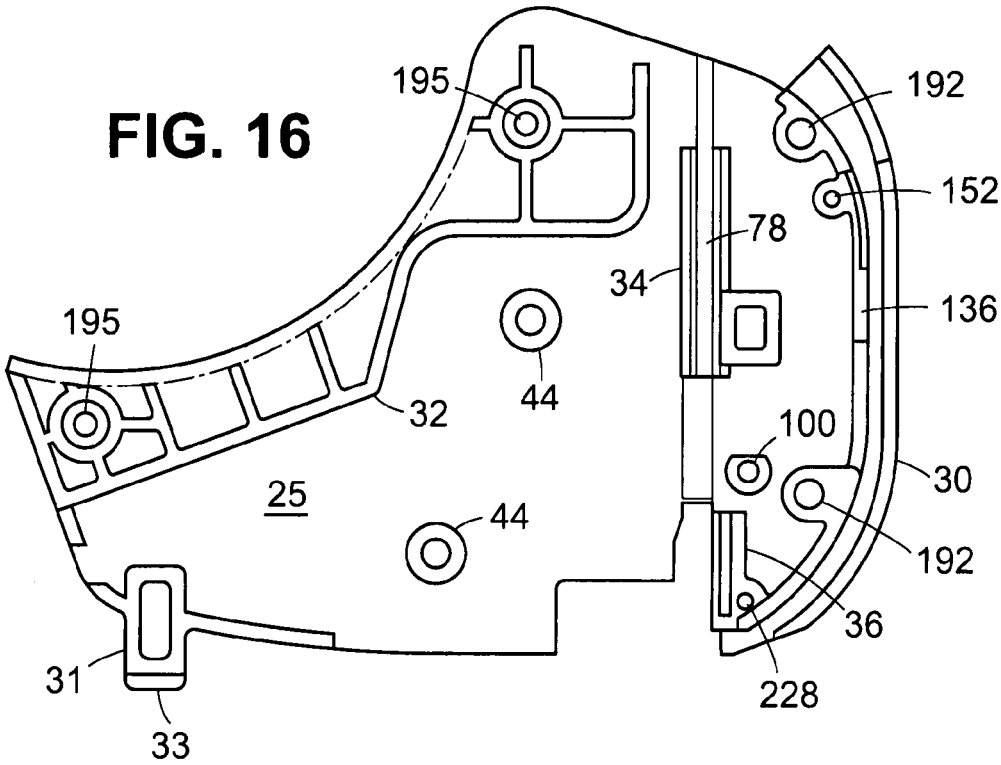
FIG. 16 is a plain view of the interior of one side of the housing for the feed mechanism.
Figure 17:
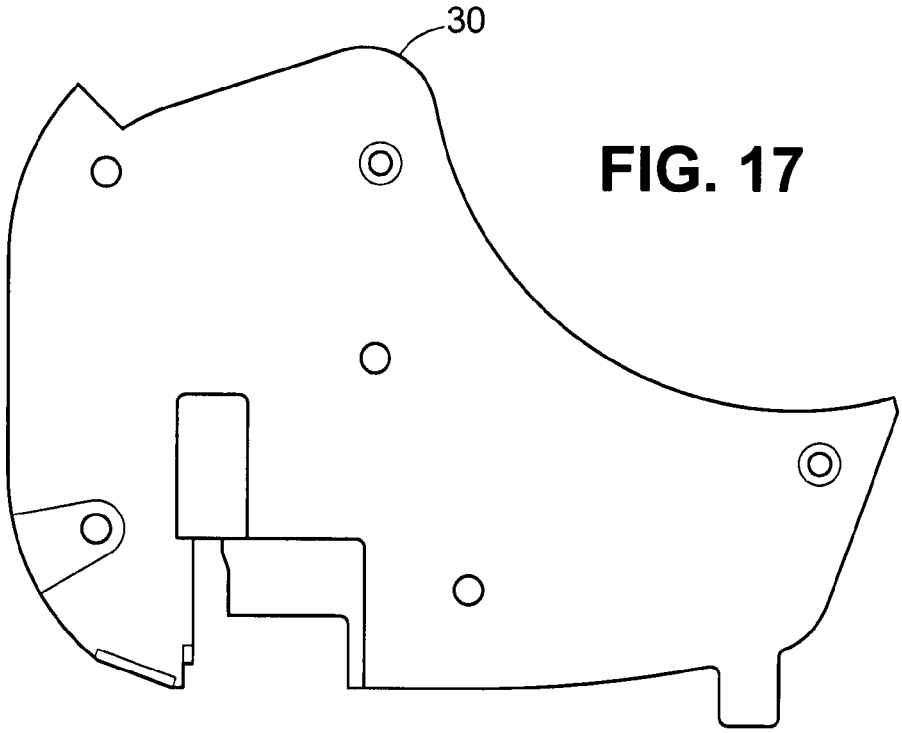
FIG. 17 is a plan view of the opposite side of the housing part shown in FIG. 16.

Housing 24 is formed of two housing sections 28, 30 which are shown in FIGS. 16, 17 and 18, 19 respectively and mate along a seam or joint line 31. As seen in FIGS. 16 and 18, the internal surfaces of these housing sections include ribs structures 32 which provide structural reinforcement for the housing as well as rigidity. They also include a plurality of aligned apertures, as described hereinafter, which permit bolts or screws to be used to secure the housing parts together and to the fastening device 10. In addition, the internal surfaces of the housing parts include upper and lower pairs of guide ribs 34, 36 which serve to guide certain of the operating parts of the mechanism during operation.

Figure 12:
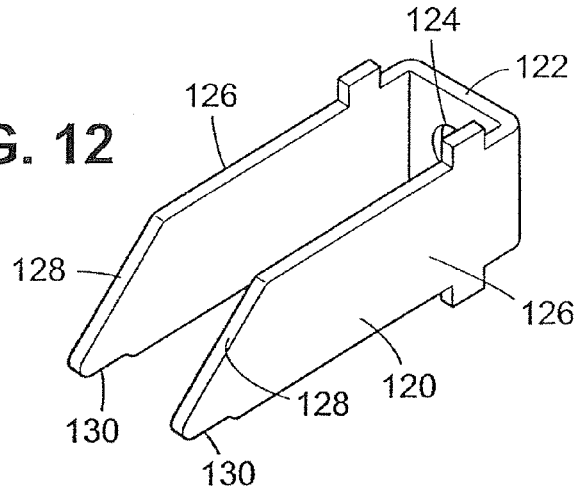
FIG. 12 is a perspective view of a pusher which lies within the bracket of FIG. 11.

As seen in FIGS. 2 and 18, the rib structure 32 in housing part 28 is shaped to define a recess 25 in the interior of the housing which conforms to the peripheral shape of the head 12 of the fastening device 10 and about half its width. The internal surface of the housing part 30 contains a similar recess 25 (FIG. 12) defined by its ribs structure 32 so that the housing halves fit tightly against the head of fastener device 10.

As will be understood by those familiar with the HT 50 hammer tacker, as seen in FIG. 1A, two external covers, 38, 40 form a part of the external appearance of the fastener device. These covers are secured in place by bolts 42 which extend through the main body part 41 and are secured on the other side of head 12 by nuts or the like, not shown. Housing parts 28, 30 include pairs of aligned apertures 44, which are located to align with the apertures in 38 and 40 when head 12 of fastener device 10 is placed in the recesses 25 of housing section 28. By simply removing bolts 42, and, for example, placing the housing section 30 over the mating portion of the housing section 28, and then resecuring bolts 42, or using longer bolts if necessary, the feed mechanism 22 is secured fast to the head 12 of the fastening device 10 for easy and secure movement therewith.

Each of the housing halves 28, 30 also has an external L-shaped leg 31 formed thereon with an opposed foot 33, located to engage beneath the head 12 of the fastener device as seen in FIG. 2, to provide additional support for the mechanism on the fastener device.

Referring again to FIGS. 2 and 18, it will be understood that the cap feed device is shown with housing section 30 and a cover plate 45 for housing section 28 (see FIG. 1A) removed for clarity. As seen therein housing section 28 includes a generally circular cavity 46 having a central inwardly projecting cylindrical post 48 formed therein. The coil 26 of interconnected caps 26', is installed in cavity 46 so it may unwind in a counter-clockwise direction, as viewed in FIG. 2. The coil is not connected to post 48, but simply wraps around it. Preferably, the inner surface 50 of cavity 46 is provided with a plurality of internal teeth 52 which are inclined in the direction of unwinding of the coil to permit the cap strip to unwind in the counter-clockwise direction. However, the raised teeth ends 53 will resist unwinding in the clockwise direction.

Post 48 has a recess 49 at its file end which defines two opposed legs 49. Once the coil of caps is placed in cavity 46 and the lead end of the coil is introduced to the adjacent passageway and advancing mechanism as described hereinafter, the circular cover disk 45 is placed over the coil and cavity to hold the coil in. As seen in FIG. 1B a simple latch member is pivotally mounted between post legs 49 on a pin or the like so that in the position shown in FIG. 1B it holds disk 45 in place and in a second position wherein it is pivoted to be aligned with post 48 the cover can be removed. The latch member 51 can be a simple friction latch or be spring biased as would be apparent to those skilled in the art.

The rib structures 32 and front walls 53, 55 of housing parts 28 and 30 define a passageway 54 which leads from the cavity 46 to the front 56 of the housing 28 and downwardly to a position 60 adjacent the front end 62 and striker 20 of fastening device 10. As seen most clearly in FIG. 1B, the edges 63 of housing parts 28, 30 along seam 31 are shaped to define an opening in the forward end 56 of housing 24 through which one or more of the caps 26' can be seen, and for additional purposes described hereinafter.

Referring yet again to FIG. 2, feed mechanism 24 includes an advance mechanism 70 which is actuated upon movement of the fastener device 10 towards and against a substrate or workpiece in order to advance caps 26', one at a time, to the driving position 21 beneath head 12 of fastening device 10. This advancing mechanism includes a system for resisting movement of the cap strip upwardly in the vertical portion of the passage 54, seen in FIG. 2, and includes a mechanism for cutting the tab connection 27 between the leading most cap 26' at the striking position 21 and the next adjacent cap as the fastener or staple is being driven through the leadmost cap, as described hereinafter.

Figure 6:
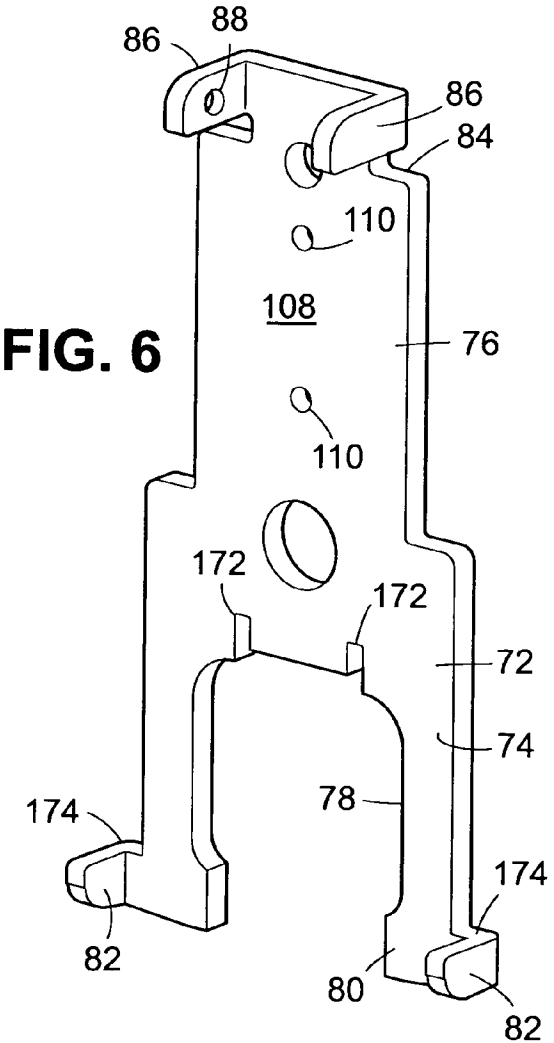
FIG. 6 is perspective view of the driver plate used in the feed mechanism.

Advancing mechanism 70 includes a drive plate 72 shown in FIG. 6. The drive plate includes a lower section 74 and an upper section 76. The upper section 76 is adapted to ride in channels 78 formed in the housing halves 28, 30 by the ribs 34. The drive plate or driver 76 is adapted to slide relative to those channels between an extended position shown in FIG. 2 and a retracted or driving position shown in FIG. 4. As seen in FIG. 2, driver 72 is located immediately in front of the front surface 62 of the head 12 of fastener device 10.

As seen in FIG. 6, the lower end 74 of driver 72 includes an enlarged slot or opening 78 through which the path of travel of the strip of caps 26' extends on its way to driving location 21. The extreme lower end 80 of plate 72 has a pair of perpendicular feet 82 formed thereon to provide an enlarged bearing surface to engage the substrate or workpiece during operation of the fastening device 10.

The upper end 84 of plate 72 has a pair of ears 86 formed thereon one of which has an aperture 88 formed therein which is used to bias the plate to its extended position as described below.

Driver 72 is biased towards its fully extended position shown in FIG. 2 by a coil spring 90. That spring is attached at one end 92 in the opening 88 in one of the ears 86. The other aligned end 94 of coil spring 90 is engaged around a roll pin or the like 96 mounted in the cylindrical recesses 100 formed on the opposite halves 28, 30 of the internal surfaces of the housing parts.

Figure 11:
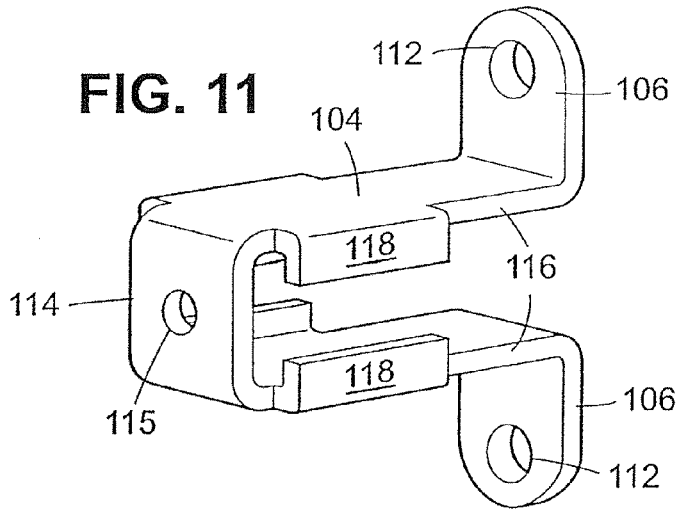
FIG. 11 is a perspective view of a bracket used in the feed mechanism.

Advance mechanism 70 includes a cap pusher mechanism 102 secured to driver 72. This pusher mechanism includes a guide bracket 104, as seen in FIG. 11, having a pair of tabs 106 which are secured by means of roll pins, rivets or the like on the front face 108 of driver 72 in the holes 110 in the driver and the holes 112 of the guide bracket. As seen in FIG. 11, guide bracket 104 is basically a U-shaped member having a bite portion 114 which faces the surface 108 of plate 72 when secured thereto as described above. In addition, the legs 116 of guide 104 include opposing tabs 118 contained therebetween which serve to guide a pusher member 120. That pusher member (FIG. 12) is also U-shaped, having a bite portion 122 including a circular opening 124 therein, and a pair of legs 126. The free ends of these legs are tapered to provide an upwardly inclining ramp surface 128 and a relatively flat bottom surface 130.

Figure 5A:
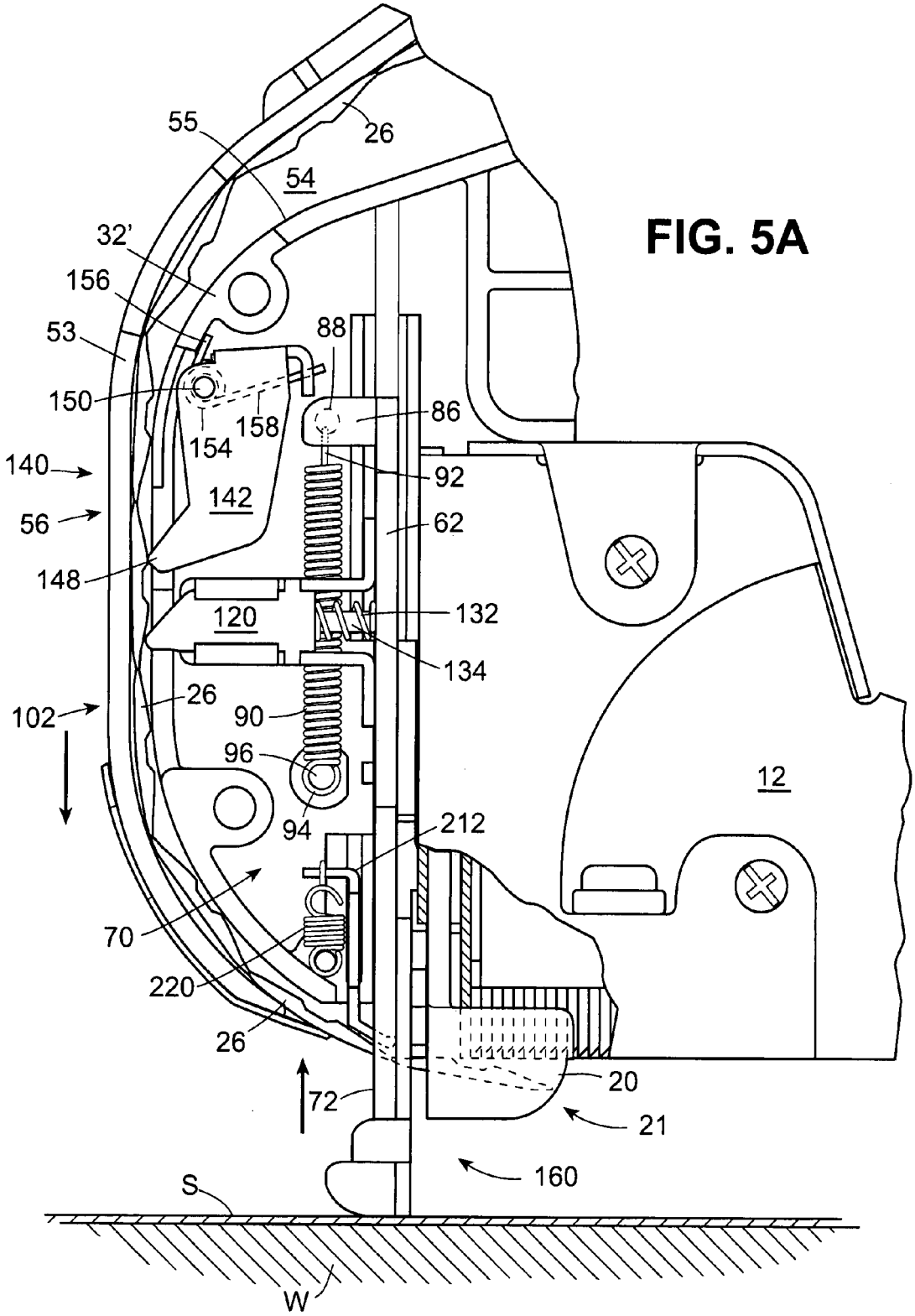
FIG. 5A is an enlarged view of the front portion of the mechanism, as shown in the position shown in FIG. 3 as the fastener device is being driven towards the work piece.

As seen in FIGS. 2 and 5A, for example, a pin 132 such as for example a roll-pin, is located within the guide 104 and secured at its opposite ends in the opening 115 of bite 114 and opening 124 of bite 122 in pusher 120. That pin is surrounded by a coil spring 134 which biases pusher 120 to the left in FIG. 2 so that its free ends enter into the vertical portion of the passageway 56 where the ends of the legs 126 can engage the caps 26'. It is noted that in this area of the passageway the rib structure and wall 55, in housing halves 30, 28, which form the passageway 56 define an opening 136 which allows the pusher 120 to move up and down with the driver plate while engaging the caps.

Figure 3:
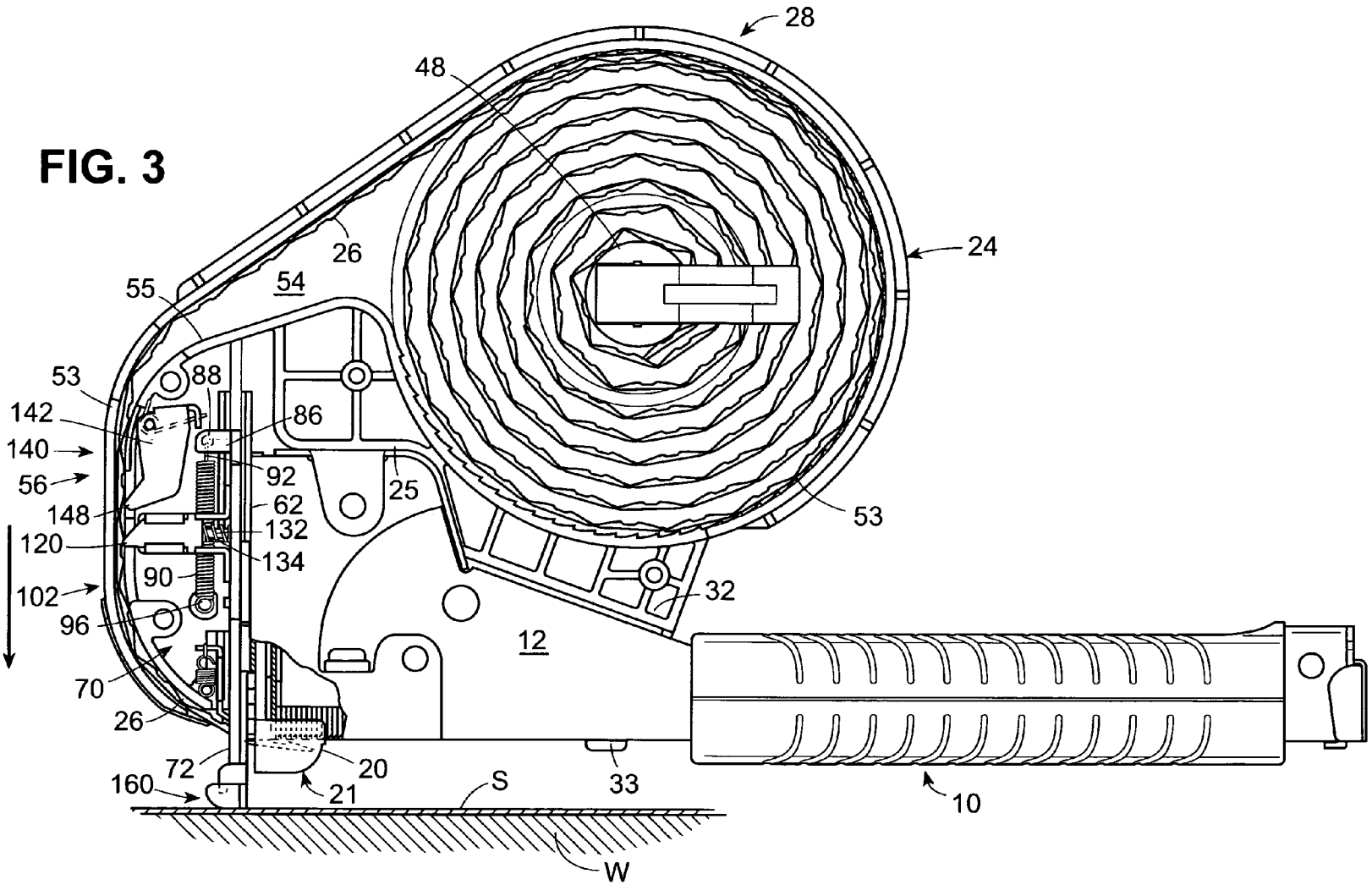
FIG. 3 is a side view similar to FIG. 2 showing the movement of the components of internal drive mechanism of the feeder as the hammer tacker is being struck against a substrate and work piece.

In the extended position of driver 72, shown in FIG. 2, the free ends of the legs 126 of pusher 120 extend between two adjacent caps in the strip of caps. As driver 72 is engaged against the work surface as seen in FIG. 3, the driver begins to move upwardly into housing 24 along the grooves 78 in the housing halves, carrying the pusher mechanism 102 with it. As plate 72 advances inwardly, pusher element 120 is pushed to the right, as seen in FIGS. 2 and 3, against the bias of spring 134, and the inclined surfaces 128 of the legs 126 ride on and over the top inclined surfaces of the adjacent cap 26'.

Figure 4:
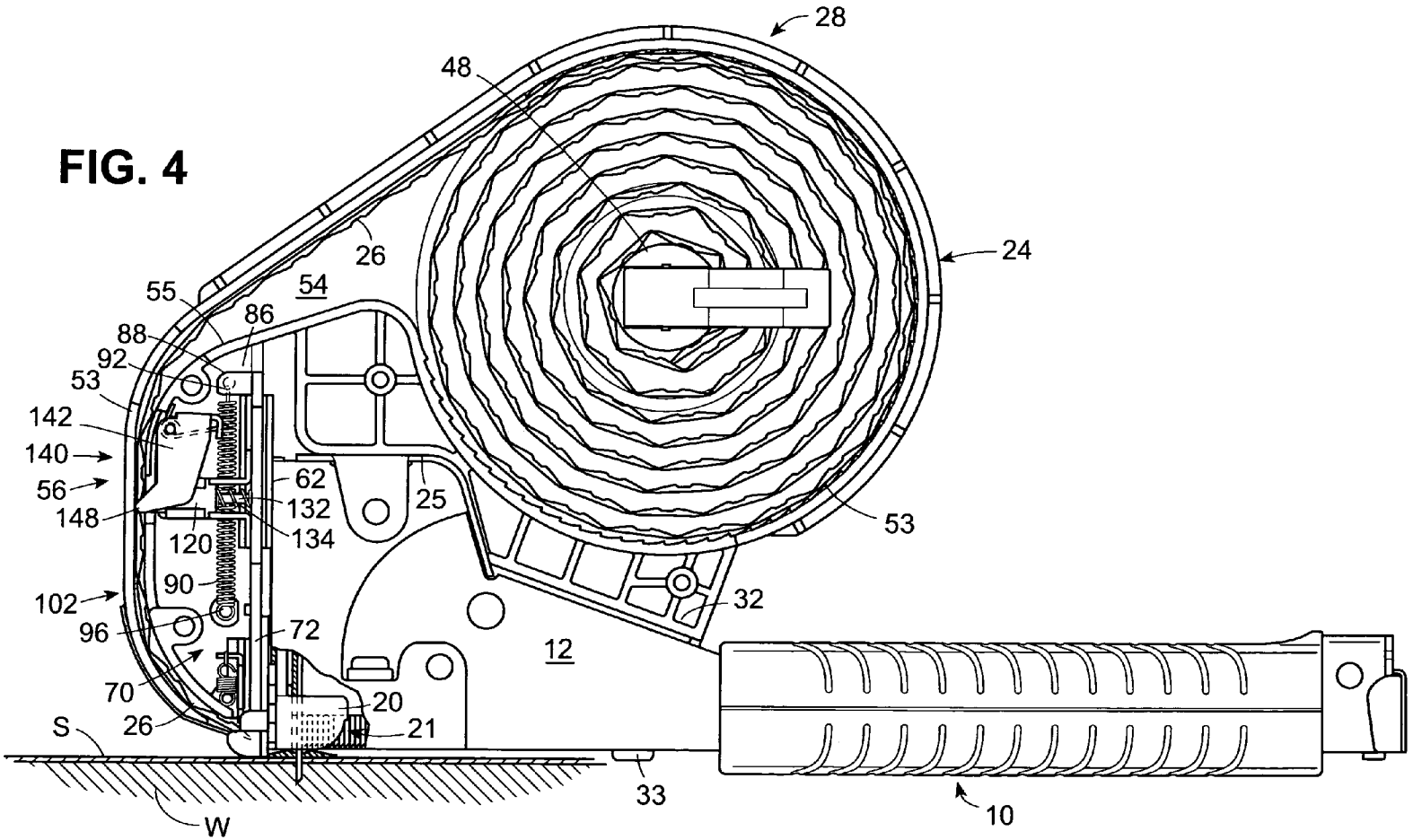
FIG. 4 is a side view similar to FIGS. 2 and 3 showing the position of the component of the device at the instant the fastener or staple has been driven.
Figure 5B:
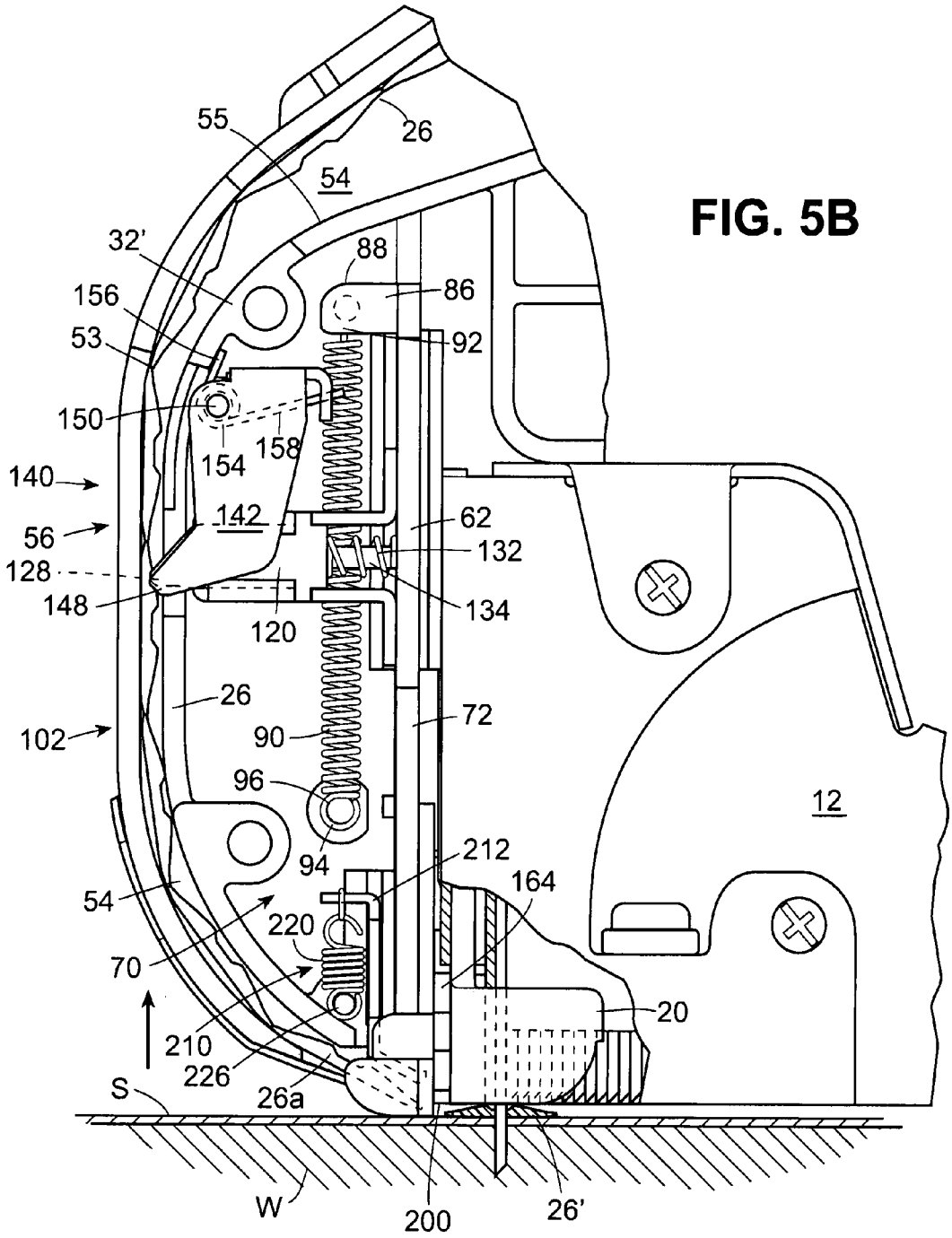
FIG. 5B is an enlarged sectional view similar to FIG. 5A and FIG. 4, showing the configuration of the components of the feeder device at the instant the fastener is fully driven.

The components of the feed mechanism are dimensioned such that when drive plate 72 reaches its internal most position, shown in FIGS. 4 and 5B, the pusher mechanism 102 arrives at the other end of the adjacent cap 26' it has just ridden over and its ends enter the space between the caps on opposite sides of the adjacent connecting strip.

When the fastening device is moved away from the workpiece, i.e., away from the position shown in FIG. 5B, the coil spring 90 will urge the driver 72 to its extended position in FIG. 2. Since the pusher mechanism moves with the drive plate, the engagement of the ends or surfaces 130 of legs 126 of the pusher against the adjacent cap cause the strip of caps to advance one cap length n passageway 56 until the position shown in FIG. 2 is reached. This is shown, for example, in FIG. 18 where the ends and surface 130 of legs 126 are shown in the lowermost position of the drive plate extending between two adjacent caps 26'.

Figure 10:
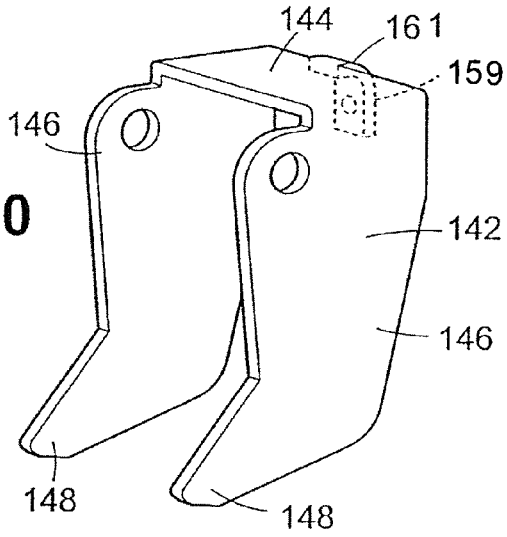
FIG. 10 is a perspective view of a stop element used in the feed mechanism.

Advance mechanism 70 also includes a stop mechanism 140 adjacent to passageway 54, to prevent upward movement of the cap strip in the passageway as a result of its engagement with the pusher 120 during the striking operation. Stop mechanism 140 includes a U-shaped stopper element 142 (FIG. 10) having a bite portion 144 and a pair of legs 146. Those legs have free ends 148 which are tooth shaped and have inclined surfaces for riding over the caps in the cap strip. As seen in FIGS. 10 and 11, legs 148 are spaced further apart than the legs 128 of the pusher 120 so that, as seen in dotted lines in FIGS. 4 and 5B, the pusher extends between the legs 148 when it arrives at its uppermost position.

Stopper 142 is pivotally mounted on a pin 150 mounted in the complementary cylindrical recesses 152 formed in housing halves 28 and 30. That pin is surrounded by a coil spring 154 having one leg 156 engaged against a rib portion 32' of the internal surface of the housing part 28 and another leg 158 received in an aperture 159 formed in a tab 161 of the stop. By this arrangement, the ends or teeth 148 of the legs 146 are always maintained in contact with the cap strip 26. In the fully extended position of driver 72, the ends 148 of the stop legs 146 are engaged in the space between two adjacent caps on either side of the connecting strip between the caps. This is also shown in FIG. 1B where it is seen that the ends 148 are located between adjacent caps 26 on each side of connecting strip 27. As a result, when the fastener device is operated to drive a staple and the drive plate 72 moves into the housing drawing the pusher 120 over the adjacent cap 26, that cap will remain in place and not move because of its engagement with the stop 142.

Referring again to FIG. 2, feed mechanism 22 also includes a cutter arrangement 160 for severing the connecting tab 27 between adjacent caps 26 when the fastener is driven through a cap into the substrate or work piece. Cutting mechanism 160 includes a first cutter 162, shown in FIG. 15 and a second upper cutter 164 shown in FIG. 13.

First or lower cutter 162 consists of a plate 165 having an opening 166 which is generally complementary to the opening 78 formed in driver plate 72. Cutter plate 165 has a pair of tabs 168 on opposite sides of the opening 166 and an additional pair of tabs 170 at the top end of the opening 166. Tabs 170 are engaged in the slots 172 formed in the upper end of the opening 78 of driver 72 and tabs 168 fit over the short legs 174 of the feet 182 on plate 72.

By this arrangement, the strip of caps passes through the opening 166 in cutter 162 on its way to the front end of the fastener driver device 10. The rear edge 176 of the plate 165 is sharpened so as to serve as a cutting edge.

Figure 9:
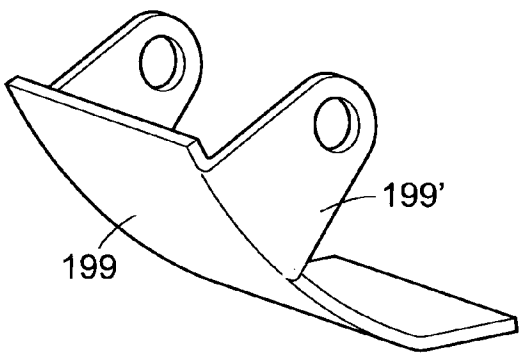
FIG. 9 is a perspective view of a cover plate used in the feed mechanism.
Figure 7:
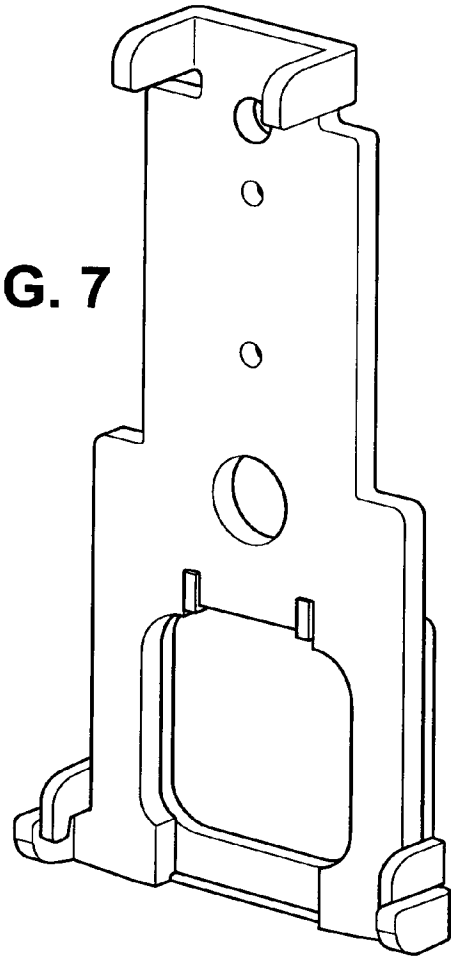
FIG. 7 is a perspective view of the driver plate of FIG. 6 and a cutter or knife mounted thereon.

As driver plate 72 is moved to its retracted position, the cutting edge 176 of the plate 165, which is mounted on plate 72 as shown in FIG. 7, will move into engagement with the lower surface of the connecting tab between two adjacent caps 26 for the purpose of severing that tab. The upper cutter plate 164 is positioned to act as a counter knife to the cutting edge 176 to effectuate the cutting step. Upper knife 164 as seen in FIG. 13 includes two pairs of ears 178 on opposite sides thereof. These ears receive in the space 180 between them a tab 182 formed in the guide plates 188 mounted on opposite sides of the housing 24, as seen in FIG. 1B. These plates, formed of metal, are supported on the housing by the bolts 42 previously mentioned, and by an additional pair of bolts 190 which extend through aligned openings 192 formed in the housing halves 28, 30. The latter bolts, along with screws 194, secure housing half 28 to half 30 together. Screws 194 entered through openings 195 formed in housing half 30 into screw bosses 196 formed in the housing part 28, to form the complete assembly. In addition a front cover plate 199 (FIG. 9) of metal may be provided over the lower front end of the joined housing halves 28, 30 by securing it to the housing by the use of lower bolt 190 which when installed extends through opening in the tabs 199 of plate 190. This plate strengthens the assembly and protects the preferably plastic housing halves from wear and damage.

With knife 164 mounted on the tab 182 in this matter, it is held against the front of the striker 20 of the fastening device, so that its lower edge 200 cooperates with the cutting edge 176 of lower knife 164 to break the tab between adjacent caps.

Figure 8:
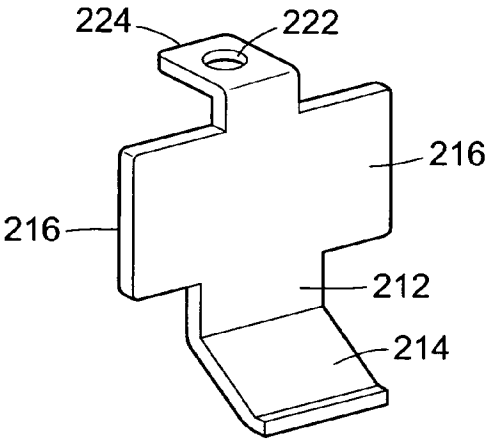
FIG. 8 is a perspective view of an ejector plate used in the feed mechanism.

Because the cap adjacent to the leadmost cap is moved upwardly by the action of the cutting device, and in order to provide additional guidance to the next adjacent cap for entry into the desired striking position beneath the head of the fastener device 10, an ejector mechanism 210 is also provided within feed mechanism 24. Ejector mechanism 210 includes an ejector plate 212 (FIG. 8) including an inclined foot 214 and a pair of tabs 216. The latter are arranged to slide in the groove 218 formed in the ribs 36 in housing sections 28, 30, with foot 214 providing an extension of the passage 54 immediately in front of and at the opening 78 of driver knife 72. Plate 212 is biased into its lowermost position by a coil spring 220 connected at one end in an opening 222 formed in a tab 224 on plate 212. The other end of the coil spring is mounted on a pin 226 secured in the aligned opposed apertures 228 formed in the housing parts 28, 30. The downward movement of the plate 212 in the grooves 218 is limited by engagement of tabs 216 against the bottom of the grooves 218.

As seen in FIGS. 4 and 5B, when a fastener is fully driven by striking of the fastener device against the substrate S and workpiece W, the upward movement of the cap 26*a* adjacent the leadmost cap 26' pushes the ejector plate upwardly into the housing. When the fastener device 10 is moved away from the substrate S, the spring 220 contracts driving the ejector downwardly, forcing the leading edge of the next adjacent plate 26A downwardly to move directly into a position below the front end of the fastener device as the pusher plate 120 drives the strip forward by the length of one cap.

Referring again to FIG. 2, it is noted that when a coil of caps is placed in cavity 46, by the construction of the present invention, the operator can manually guide the leading end of the cap strip and urge the leading cap in the strip past the end of stopper 142, at that point the cover plate 45 is installed and the device will advance the lead cap through the remainder of passageway 54 simply by the manual depression and release of plate 72 until the lead cap is moved into position beneath the driving area of the fastener device. Thus eliminating need to unnecessarily operate the fastener driving device.

Figure 21:
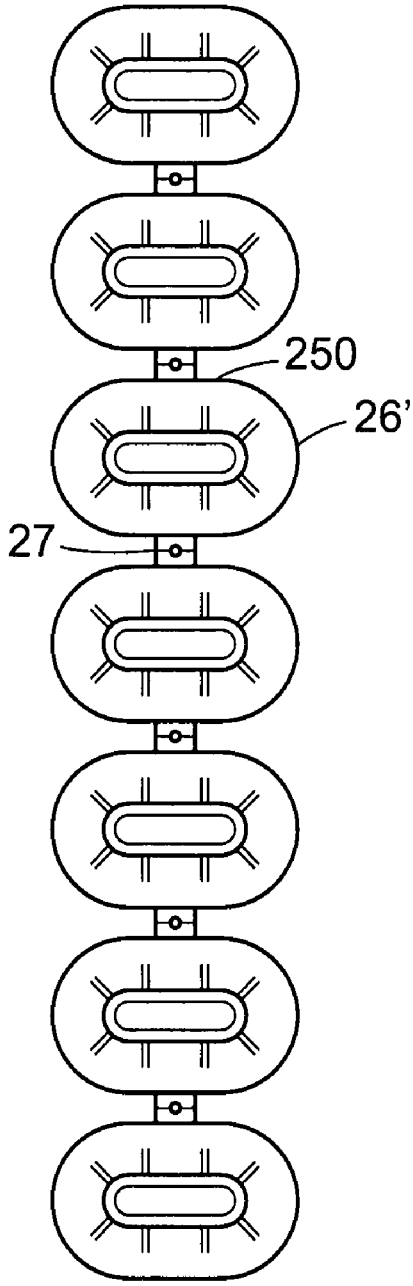
FIG. 21 is a bottom view of a portion of the strip of caps used in the present invention.

Caps 26', as seen in FIGS. 20 and 21 are preferably somewhat oval shaped and have flat sides 250 connected by narrow strips of plastic 27. The flat sides serve to better engage the legs of the pusher and stop arrangements. The top surface edges of the caps are preferably inclined to provide a camming action against the pusher and stop as described above. The center oval section 252 is recessed to reduce the cap's thickness to make it easier for the fastener leg or legs to penetrate. Indeed, if desired, the specific area where the fastener penetrates can be made even thinner, as indicated at the small circular areas 254 at which the legs of a staple would penetrate. Of course it would be understood by those skilled in the art that other known cap structures and shapes may be used.

Accordingly, it is seen that a relatively simple continuous feed cap advancing mechanism has been provided which can easily be attached to an existing or pre-owned fastener device. It is to be understood that although the illustrative embodiment of the invention is particularly adapted for use with the well-known HT 50 brand staple gun tacker, the internal configuration of the rib structure on the housing parts can be adapted to other shaped drive heads such as used for example with hammer tackers of other manufacturers like The Stanley Works and others. In that case, the rib structures 32 for example are modified to accommodate a differently shaped head.

In operation, as described above, when the fastener device 10 is driven as in the act of driving a nail, with the feed mechanism of the present invention attached, the feet 82 of the driver plate 72 initially contact the substrate S or work surface W and the plate begins to move upwardly against the bias of the spring 90. As it does so, the pusher 120 rides along the adjacent cap 26' in the vertical portion of the passageway 54. As the plate 72 continues to move upwardly, the foot 20 of the fastener device then engages the substrate or work surface and begins to move inwardly as well into the drive head. This motion ultimately actuates the fastener device to drive a fastener through a cap below it and into the substrate and/or work place as seen in FIG. 4. As this occurs, the driver plate 72 also reaches its uppermost position allowing the free ends of the pusher 120 to enter the space between the next adjacent cap and the one it just rode over between the legs 148 of the stop device 140. As noted above, the stop device 140 prevents the cap strip from moving upwardly in channel 54 as the pusher rides over the adjacent cap in moving to its uppermost position.

As the plate 72 is moving to its innermost position and the staple is being driven, the cutter edge 175 of the lower cutter mounted on the plate 72 moves towards the lower edge of the upper cutter, in a parallel path, which action serves to cut or break the connecting tab 27 between the lead cap 26' and its immediately adjacent cap 26*a*.

When the fastener driving device is moved away from the work piece, the striker of the fastener driving device and the drive plate 72 both return to their extended positions. As that occurs, the pusher 120 moves downwardly, to advance the cap strip by the length of one cap, moving the next cap, e.g. 26*a*, into position beneath the fastener device head 12 in the area 21. At the same time the ejector plate moves downwardly under the influence of its associated spring 226, to push the cap 26' downwardly in the desired path of travel.

Although an illustrative embodiment of the invention has been described herein with reference to the accompanying drawings, it is to be understood that various changes and modifications may be effected therein by those skilled in the art without departing from the scope or spirit of the invention. In addition, it is noted that the invention is not limited in its application to staple gun tackers, but to any form of tacker or fastener device to which the continuous feed device can be mounted.

What is claimed is:

1. A combination fastening device and continuous feed cap mechanism comprising, a fastening device, having a fastener driving location, magazine means for holding a plurality of fasteners and advancing the same to the fastener driving location as fasteners are driven and means for manually actuating the fastener driving device to drive a fastener at the fastener driving location into a work piece upon engagement of the actuating means with the work piece; and a continuous cap feed mechanism including a housing, a coiled strip of interconnected caps contained in said housing and means for removably mounting said housing on said fastener driving device;

said housing including a passage way for guiding the strip of caps from the coil to a position adjacent to and beneath the fastener driving location of said fastener driving device and means in said housing for advancing the leading cap on said strip from said passage to said position adjacent and beneath the fastener driving location of said fastening device after the fastening device has been operated to drive a prior fastener and as the housing and fastener driving device are moved away from the work piece; and said means for advancing the leading cap including driver means acting independently of said means for actuating the fastener driving device for causing the advancing means to advance said leading cap as the fastener device is moved away from the work piece.

2. The combination as defined in claim 1 wherein said fastener driving device is a manually operated hammer tacker including a drive head and an elongated handle, said head including means for driving a fastener responsive to the striking of said head against a work piece.

3. The combination as defined in claim 2 wherein said hammer tacker includes cover components secured to said head by a plurality of bolts through bolt holes at defined locations on the head and said housing is secured to the head of the hammer tacker, without modification of the hammer tacker, its actuating means, or the cover components, by a plurality of bolts mounted through the housing and said bolt holes.

4. The combination as defined in claim 1 wherein driver means includes a driver plate movably mounted in the feed mechanism housing adjacent the path of travel of the caps at the fastener driving location of the fastener driving device for movement between an extended and retracted position, said driver plate being moved from its extended to its retracted position as it engages the work piece to which the cap is to be fastened, means for biasing said driver plate towards said extended position, and means connected to said driver plate for engaging a cap in said strip in the feed mechanism housing passageway and urging said strip in said passageway towards said fastener driving location as the driver plate returns to its extended position when the housing and fastening device to which it is mounted are moved away from said work piece.

5. The combination as defined in claim 4 wherein said driver plate has a contact end for engaging the work piece as the fastening device's fastener driving location is moved towards a work piece, and said contact end of the driver having an opening therein through which the strip of caps pass on its path of travel from the passageway.

6. The combination as defined in claim 5 including cutting means mounted on said driver plate for cutting the connection between the leading cap and the next adjacent cap as the driver plate approaches its fully retracted position.

7. The combination as defined in claim 6 wherein said cutting means includes an opening in the driver plate through which said caps pass and a lower edge on said opening below the path of travel of the caps, said lower edge including a sharpened cutting edge.

8. The combination as defined in claim 7 including second cutter means mounted in said housing in a fixed position above and adjacent the path of travel of the cap strip and adjacent the path of travel of the driver whereby the two cutting means cooperate to separate the lead cap from the next adjacent cap.

9. The combination as defined in claim 4 wherein said means for urging the strip in said passageway towards the fastener driving device's fastener driving location comprises a pusher mounted on the driver plate for movement towards and away from said strip and located to be positioned between two adjacent caps in the strip at each of the extended and retracted positions of the driver plate, and means for biasing said pusher towards said strip.

10. The combination as defined in claim 9 wherein said pusher includes a pair of pusher arms having tapered ends for pushing against one of the caps in the strip as the driver plate returns from its retracted to its extended position and for riding over a cap against the pusher biasing means as the driver plate moves from its extended to its retracted position.

11. The combination as defined in claim 6 including means for pushing said next adjacent cap away form said cutter means as said driver returns to its extended position.

12. The combination as defined in claim 7 wherein said means for pushing comprises a pusher plate movably mounted in said housing adjacent the driver plate and means for biasing the pusher plate to an extended position below the point at which said cutter means cuts said adjacent caps, whereby the pusher plate retracts in the housing as the next adjacent cap is cut and the pusher plate is biased to push said next adjacent cap in the same direction as the driver plate moves in returning to its extended position.

13. The combination as defined in any one of claims 4 to 12 wherein said fastener driving device is a manually operated hammer tacker including a drive head and an elongated handle, said head including means for driving a fastener responsive to the striking of said head against a work piece.

14. The combination as defined in claim 13 wherein said hammer tacker includes cover components secured to said head by a plurality of bolts through bolt holes at defined location on the head and said housing is secured to the head of the hammer tacker without modification of the hammer tacker, its actuating means, or the cover components by a plurality of bolts mounted in said bolt holes.

15. The combination as defined in claim 1 including means in said housing for holding the cap strip in said passage against movement while the driver moves from its extended to its retracted position.

16. The combination as defined in claim 15 wherein said holding means comprises a latch member pivotally mounted in the housing and having a pair of fingers engaging caps in the strip and means for biasing said fingers into engagement with the cap in the strip.

17. The combination as defined in claim 16 wherein said holding means comprises a latch member pivotally mounted in the housing and having a pair of fingers engaging caps in the strip and means for biasing said fingers into engagement with the caps on the strip.

18. The combination as defined in claim 17 wherein said latch member is located to position said fingers between the same two caps in the strip where said pusher is located in the retracted position of the driver.

19. The combination as defined in claim 18 wherein latch is located to position said fingers between the same two caps in the strip where said pusher is located in the retracted position of the driver, and wherein the fingers of said latch are spaced apart further than the pusher arms of said pusher.

20. The combination as defined in claim 1 wherein said housing has a removable side to allow installation of said coil of caps.

* * * * *